United States Patent [19]

Waits et al.

[11] 4,404,965

[45] Sep. 20, 1983

[54] SKIN MASSAGE DEVICE

[75] Inventors: Kym H. Waits; Roland S. Sedziol, both of Cincinnati, Ohio

[73] Assignee: Kym H. Waits, Cincinnati, Ohio

[21] Appl. No.: 343,270

[22] Filed: Jan. 27, 1982

[51] Int. Cl.[3] ..... A61H 7/00

[52] U.S. Cl. ..... 128/46; 15/22 R

[58] Field of Search ..... 128/44, 45, 46, 48, 128/49, 51, 52, 24.1, 24.2; 15/22 R

[56] References Cited

U.S. PATENT DOCUMENTS

| | | | |
|---|---|---|---|
| 1,782,005 | 11/1930 | Grison | 128/44 |
| 1,931,849 | 10/1933 | Matson | 128/45 |
| 2,431,979 | 12/1947 | Amer | 128/46 |
| 2,706,980 | 4/1955 | Kahn | 128/44 |
| 3,467,080 | 9/1969 | McNair | 128/24.2 |
| 3,503,305 | 3/1970 | Meyer | 128/24.2 |
| 3,699,952 | 10/1972 | Waters et al. | 128/24.2 |
| 3,733,634 | 5/1973 | Golbe | 15/28 |
| 3,818,904 | 6/1974 | Kawada | 128/56 |
| 3,906,940 | 9/1975 | Kawada | 128/40 |
| 3,993,052 | 11/1976 | Miyahara | 128/46 |
| 4,291,685 | 9/1981 | Taelman | 128/24.1 |

FOREIGN PATENT DOCUMENTS

| | | | |
|---|---|---|---|
| 75288 | 12/1916 | Switzerland | 128/46 |

OTHER PUBLICATIONS

"The Black Woman's Beauty Book" by LaVerne Powlis, pp. 108, 109.

"Harper's Bazaar", Mar. 1980, p. 102.

*Primary Examiner*—John D. Yasko

*Attorney, Agent, or Firm*—Wood, Herron & Evans

[57] ABSTRACT

A hand held massage device which provides a massage pattern that approximates the desirable circular and spiral pattern of a hand facial massage. In preferred form, the device comprises a housing presenting a rotatable support table and a massage element that is mounted on the support table. The massage element is rotated by a shaft extending through the support table and offset from the rotating axis of the table. Separate drive trains for the support table and the massage element rotate the massage element for part of a cycle while the support table remains stationary, after which the support table and massage element are simultaneously rotated in opposite directions. The rotations of the massage element and the support table combine to provide a reversing circular motion followed by an increasing, then decreasing spiral massage motion, wherein a selected point on the massage element follows a first directional path comprising a circle about the axis of the massage element, then a second directional path in the opposite direction and comprising a semicircle followed by an increasing, then decreasing spiral path about the axis of the support table.

13 Claims, 10 Drawing Figures

SKIN MASSAGE DEVICE

BACKGROUND OF THE INVENTION

1. Field of the Invention

The present invention relates to a skin massage device. More particularly, the present invention relates to a hand held, electrically operated, skin massage device particularly adapted to massage the face and to apply soaps, cleansers, creams, lotions, and other cosmetic preparations to the skin of the face. Still more particularly, the present invention relates to a facial skin massage device capable of reproducing a specific massage motion or pattern such as might normally be used when massaging the skin of the face with the finger tips of the hands.

2. Description of the Prior Art

Massage of, and the application of soaps, cleansers, creams, lotions, and other cosmetic preparations to, the skin of the body are often done by hand, as contrasted to the use of mechanical devices. This is particulary true with respect to the face, where more sensitive skin and the sharp contours of the face demand gentleness in the massaging act and precision in the massaging motion or pattern. It is generally accepted that good facial skin care should include regular facial massage, and that a desirable way of hand massaging is with a gentle, but firm, upward and outward, two directional motion or pattern. Hand massaging in this manner, especially when used in conjunction with the application of any of various cosmetic preparations, improves the circulation and tones the skin. It can also reduce oiliness and flakiness, and generally will give a more healthful and attractive appearance to all types of skin.

The prior art is replete with mechanical devices intended for massaging various parts of the body, some of which have been designed specifically for use in connunction with the skin of the face. Such facial massage devices are usually hand held instruments and generally comprise a movably mounted massage element or applicator comprising a brush or buffer. The massaging element or applicator is connected through a drive train to a source of power by which motion is imparted to it, the type of motion depending upon the particular instrument. In this latter respect, U.S. Pat. Nos. 3,733,634, 3,818,904, and 3,906,940 illustrate several hand held facial massaging devices in which the structure of each differs from that of the others, but in which the motion imparted to the massaging applicator of all the devices is essentially the same, i.e., circular. Other hand held massage devices are shown in U.S. Pat. No. 3,993,052, in which a plurality of applicators are eccentrically mounted; U.S. Pat. No. 3,699,952, in which the applicator mounted is designed to produce a vibratory massaging action; and in U.S. Pat. Nos. 1,782,005; 3,467,080; 3,503,395; and 4,291,685; some of which combine the massaging action with the application of heat. Other devices for massaging various parts of the body, such as those of U.S. Pat. Nos. 1,931,849 and 2,706,980, have been equipped with a plurality of massaging elements intended to simulate the fingers of the hand, each of which fingers is given a motion which, when combined with that of the other fingers, produces a kneading or reciprocating action not unlike that resulting from moving the fingers of the hand to and fro in actual hand massage.

It is generally agreed that an upward and outward circular motion using the tips of two adjacent fingers, is especially desirable for facial massage. This type of motion is recommended, for example, in "The Black Woman's Beauty Book," by LaVerne Powlis, which states that applying soaps in "an upward, outward circular motion" retards wrinkles. *Harper's Bazaar,* in the issue of March 1981, at p. 102, also recommends such massage motion. Nevertheless, none of the prior art devices duplicates, nor attempts to duplicate, the circular and spiral motion that is so often practiced in hand facial massage, and which so effectively contributes to a clean and healthful appearing facial complexion.

SUMMARY OF THE INVENTION

It is the principal object of this invention, therefore, to provide a device designed for massaging various areas of the body. It is a further object of this invention to provide a device that is particularly designed for massaging, applying cosmetic preparations to, and/or for epidermabrasion of, the skin of the face. It is a still further object of this invention to provide a mechanical means for massaging the skin of the face in a gentle, soothing, but firm, manner using a two directional upward and outward motion similar to that which can be obtained when massaging with the fingers of the hands. A further object of the invention is to provide a hand portable massaging device, the massaging applicator of which is designed to resemble the shape of the fingertips of the hand and to produce a sensation in the skin of the face similar to that obtained when massaging by hand. Another object of the invention is to provide a hand portable massaging device that is compact, conveniently used, and readily transported in overnight traveling luggage.

Unlike previous facial massage devices, the present device provides a reversing circular and spiral form of movement which more closely approximates the desirable massaging movement recommended by skin care experts. This form of motion is far more complex than the simple linear or rotary movement of past devices. One of the major objectives of this invention has been to provide a hand holdable drive for generating this complex type of motion.

The facial massage device according to this invention comprises a housing adapted to be held in the hand and having a massage member mounted in the wall thereof. The massage member preferably comprises a rotatably mounted support table and a separately rotatable massage element mounted by the support table, in close proximity to the exposed surface of the table but offset from the mounting of the latter. Within the housing is an electric motor connected to a suitable source of power which, through two different drive trains, is capable of imparting different rotary motions to the support table and the massage element. The massage element is contoured so as to resemble the finger tips of the index and middle fingers of the hand so that the massage device provides, when placed in operation, a contact with the skin similar to that experienced during hand massage. The housing of the device is preferably provided with an on-off switch and a variable speed control, and is equipped with means adapting it to house current and/or to battery power. A configuration is provided the housing so that the device will fit comfortably in the hand and against the surface of the body, especially when used for facial massage.

When the massage device is in operation, the support table and massage element are caused to rotate differently. In a complete preferred cycle, rotation of the support table is initiated after a full revolution of the massage element has been completed. Thereafter the support table and massage element rotate simultaneously until the massage cycle is completed. If a given point on the massage element tip is selected and followed through the preferred massage cycle, it traces, from an assumed starting point, a first directional path of generally circular configuration as the massage element rotates circularly about its own axis through one revolution while the support table remains stationary. As the massage element continues to rotate about its own axis, the selected point will next trace a second path in the opposite direction as the support table begins to rotate about its own axis carrying with it in rotation the oppositely rotating massage element. Because the massage element rotating about its own axis in one direction while it orbits about the axis of the support table which itself rotates in the opposite direction, the second directional path traced by the selected point will first be generally semicircular, followed by an increasing, then decreasing spiral configuration, preferably comprising a half circle, one revolution of increasing spiral configuration, then one and one-half revolutions of decreasing spiral configuration, at which point the massage cycle is complete, following which the cycle is repeated.

BRIEF DESCRIPTION OF THE INVENTION

Figure 2:
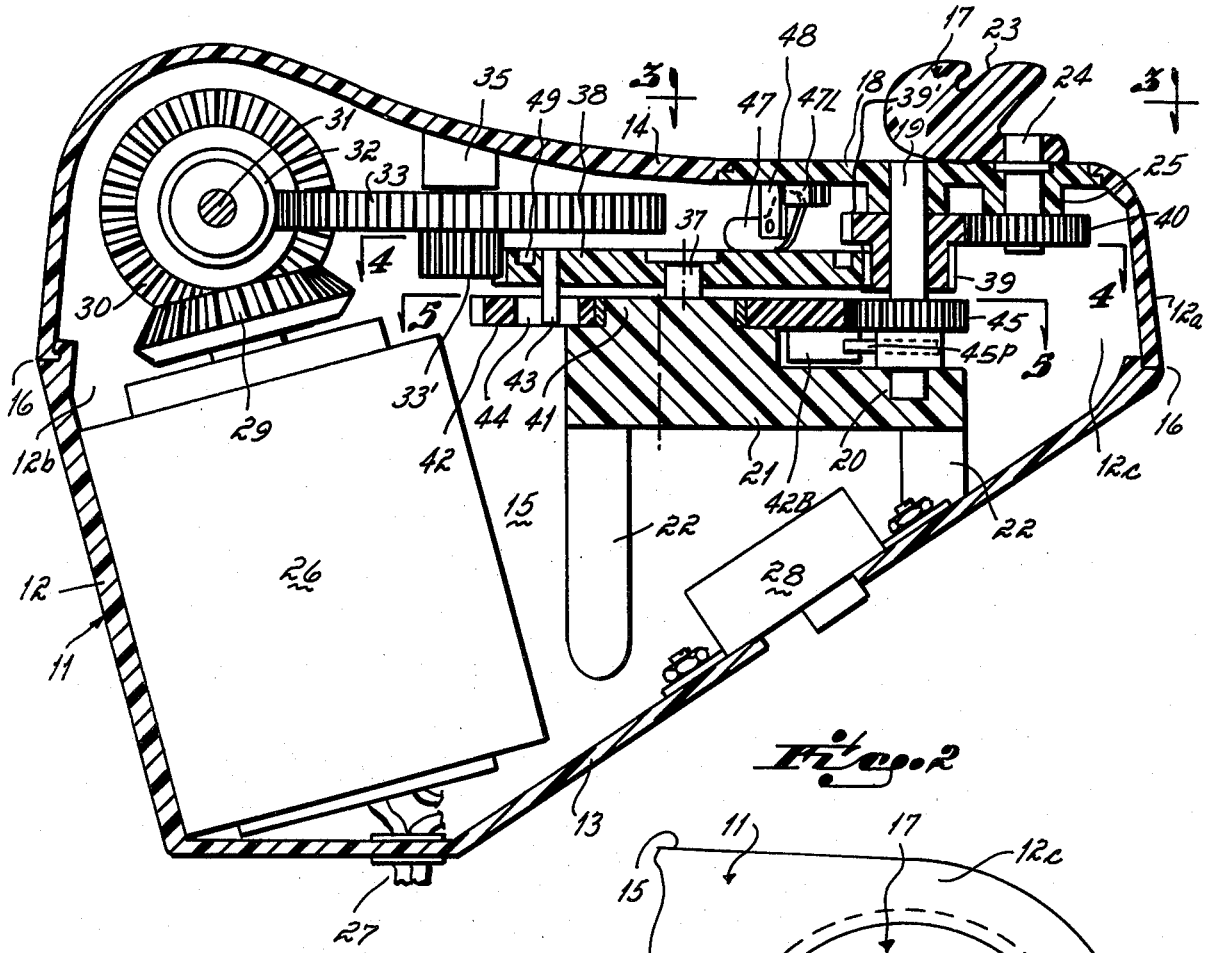
FIG. 2 is a longitudinal sectional view of a preferred embodiment of the massage device of this invention.
Figure 3:
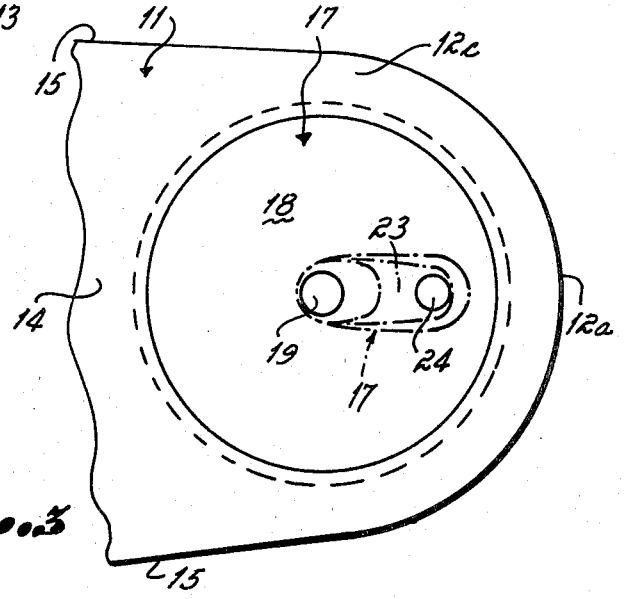
FIG. 3 is an enlarged fragmentary top view, taken on the line 3—3 of FIG. 1.
Figure 4:
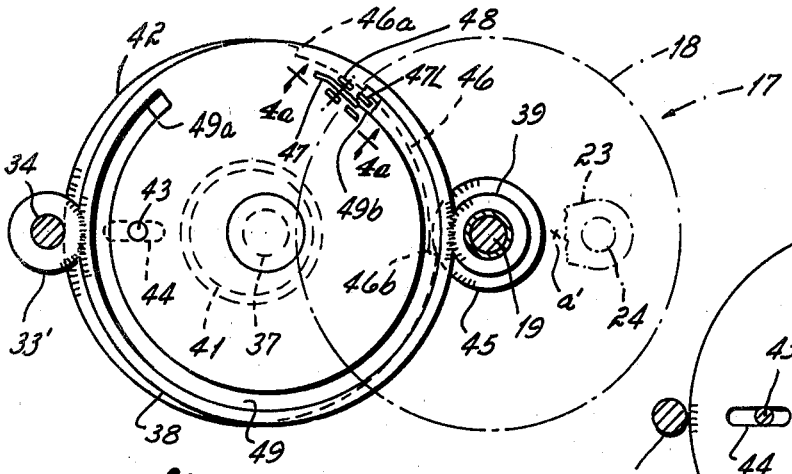
FIG. 4 is a top sectional view of a portion of the gear trains, taken generally on the line 4—4 of FIG. 2, and showing the locking dog in the locked position.
Figure 5:
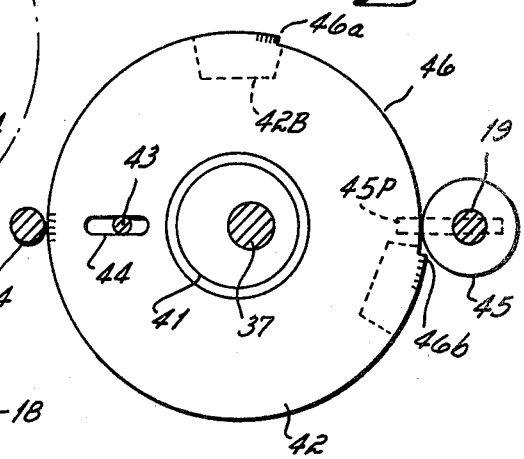
Figure 6:
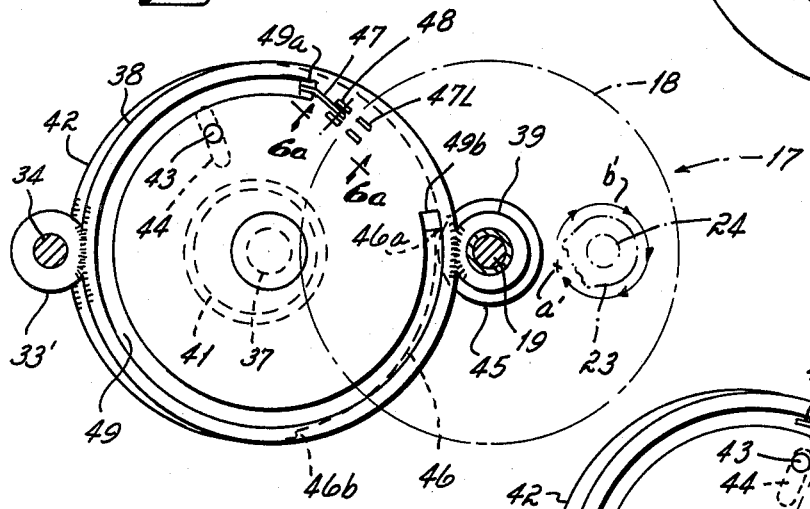
Figure 7:
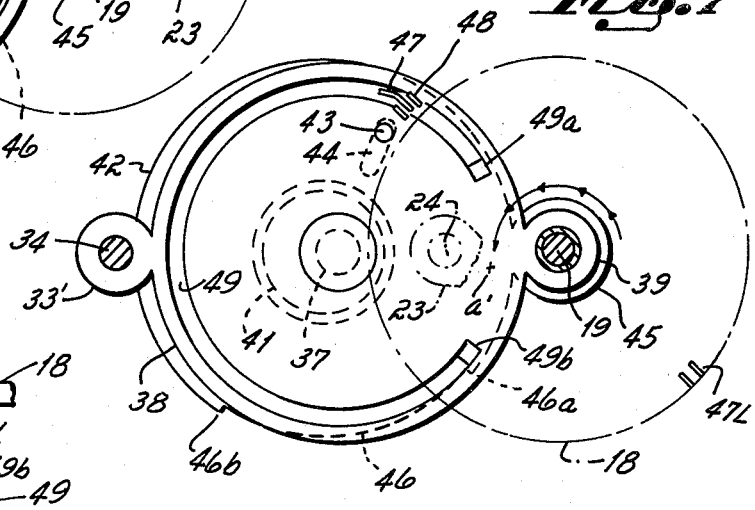
Figure 4A:
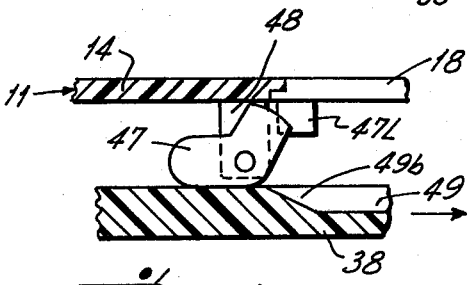
Figure 6A:
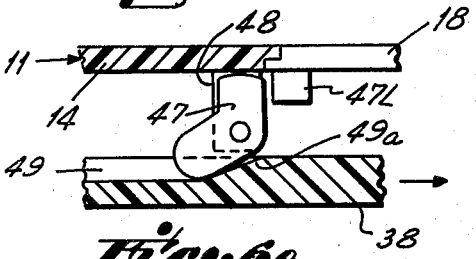
Figure 8:
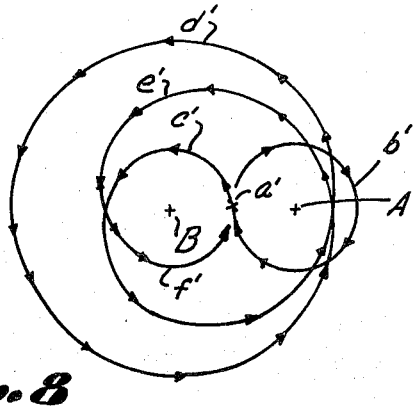

FIG. 4*a* is an enlarged view of the locking dog taken on the line 4*a*—4*a* of FIG. 4;

FIG. 5 is a top sectional view of another portion of the gear trains, taken generally on the line 5—5 of FIG. 2;

FIG. 6 is a top sectional view similar to FIG. 4 but showing the locking dog in the unlocked position;

FIG. 6*a* is an enlarged sectional view of the locking dog taken on the line 6*a*—6*a* of FIG. 6;

FIG. 7 is a view similar to FIG. 5 but showing the gear drive trains' function when the locking dog is in its unlocked position; and FIG. 8 is a diagrammatic view illustrating the two directional path followed by a selected point on the massage element of the device of this invention during a complete massage cycle.

DESCRIPTION OF THE PREFERRED EMBODIMENT

Figure 1:
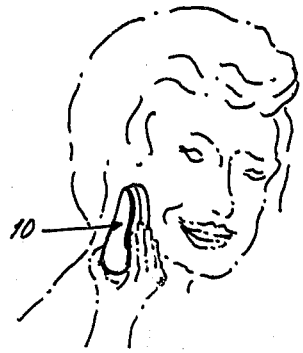
FIG. 1 is a perspective view illustrating the device of this invention being used for facial massage.

Referring to the drawings, FIG. 1 shows a preferred form of the massage device 10 of this invention in its application as a facial massager, for which it is especially suited. As shown in FIG. 2, massage device 10 comprises a housing 11 fabricated from a suitable lightweight, premolded, plastic material contoured to be held comfortably in the hand when in use. Housing 11 is formed by end walls 12 and 12*a*, bottom wall 13, a top wall 14, and side walls 15, all of which are joined together by lock joints 16, or other suitable means, to form a unit having a large end 12*b* and a small end 12*c*. Mounted in an opening in top wall 14 and situated toward the small end 12*c* of housing 11 is a massage member 17 comprising a circular support table 18, perferably fabricated of the same material as housing 11, which is keyed to a rotatable central drive shaft 19. Drive shaft 19 is supported in bearing means 20 carried in base 21 which, in turn, is supported within housing 11 by brace members 22. Also constituting a part of massage member 17 is massage element 23 mounted by and in close proximity to the surface of support table 18. Element 23 is rotatable on table 18 by means of a second drive shaft 24 to which it is keyed. Drive shaft 24 is rotatably mounted in bearing carrying boss 25 positioned in support table 18, and is offset with respect to central drive shaft 19 near the perimeter of support table 18. Massage element 23 is preferably contoured in the shape of the fingertips of the index and middle fingers of the hand and is fabricated from any material, plastic or otherwise, suitable for the purpose.

Mounted in the large end 12*b* of housing 11 is an electric motor 26 which may be connected to a battery source of power, not shown, within housing 11, or alternatively, to an outside source of power, i.e., ordinary house current, through means 27. Secured in bottom wall 13 of housing 11 is an on-off switch 28 for electric motor 26 which may also be provided with a variable speed control permitting massage member 17 to be operated at different rates of speed. Mounted on the drive shaft of motor 26 for rotation therewith is a bevel gear 29 which meshes with another bevel gear 30 carried by shaft 31 journaled in bearings, not shown. Also keyed to shaft 31 is a worm gear 32 meshing with a gear 33 of a double or concentric gear 33-33' which is rotatably mounted on shaft 34 secured in boss 35. Through the motor drive train comprising bevel gears 29 and 30, worm gear 32 and concentric gear 33-33', the motion of the drive shaft of motor 26 is delivered to support table 18 and massage element 23 through two subsequent drive trains which will hereinafter be described.

Rotatably mounted on a shaft 37 secured in base 21 of housing 11 is a large gear 38 which on one side meshes with smaller gear 33' of double gear 33-33', and at a diametrically opposite point with a gear 39 of another double or concentric gear 39-39' on the other side. Double gear 39-39' is mounted to rotate freely on shaft 19, and to mesh through gear 39' with a gear 40 keyed to massage element shaft 24. The drive train for massage element 23, therefore, comprises gear 38, concentric gear 39-39' and gear 40.

Rotatably mounted on a boss 41 in base 21 of housing 11 is a large gear 42 which is positioned beneath gear 38. The center of boss 41 is offset from the axis of shaft 37, so that gears 38 and 42 are not concentric, as shown in FIGS. 1 and 4. Gear 42 is driven by gear 38 through a drive pin 43 which is integrally associated with gear 38 and which rides in a radial slot 44 in gear 42. Slot 44 acommodates the relative shifting movement of pin 32 as gears 38 and 42 rotate about their different axes of rotation. Meshing with gear 42 is a gear 45 which is keyed to and drives shaft 19 and, through it, support table 18. The drive train for support table 18, therefore, comprises gear 38, pin 43, gear 42, and gear 45.

By way of example and not limitation, suitable tooth relationships for these gears are:

| | |
|---|---|
| Gear 38 | 60 tooth |
| Gear 39 | 12 tooth |
| Gear 39' | 18 tooth |

-continued

| | |
|---|---|
| Gear 40 | 18 tooth |
| Gear 42 | 60 tooth, 14 teeth cut out |
| Gear 45 | 16 tooth |

As best shown in FIG. 5, gear 42 is provided with a cut-out or tooth skip section at 46. In the preferred embodiment, drive skip section 46 comprises one-fifth of the circumference of gear 42; for that purpose, 12 teeth are cut out, with two additional teeth advantageously being removed for clearance. When gear 42 is at an angular position such that the skip section is passing the teeth of gear 45, no motion is imparted to shaft 19 or support table 18. Motion is continuously delivered to massage element 23 through the drive train comprising gears 38, 39-39', and 40. While the skip tooth portion of gear 42 is moving past gear 45, the gear 40 and the massage element 23 driven by it make one full revolution; but table 18 does not move. It is this intermittent coupling and decoupling of the one drive train to table 18, together with the continuous movement imparted to the massage element, that combine to give the unique circular/spiral output movement.

It is desirable but not absolutely necessary, to prevent rotation of table 18 during the time the skip tooth section 46 of gear 42 is passing gear 45; this insures that the teeth of gears 42 and 45 will be in proper meshing alignment when the teeth at the trailing edge of skip section 46 meet the teeth of gear 45. For this purpose a locking dog 47 and latch means 47L are provided, as shown in FIGS. 4*a* and 6*a*. The dog 47 is pivotally mounted between supports or legs 48 projecting inwardly from housing top wall 14, and the latch 47L comprises two spaced ears or tabs projecting from table 18.

Locking dog 47 is actuated by a cam, the low portion of which is defined by an arcuate recess or groove 49 in the upper surface of gear 38. The length of this recess arc corresponds inversely to that of tooth skip section 46, that is, in this embodiment the arc extends for 4/5 the circumference of gear 42. Its position is such that the trailing edge 49*b* of recess 49 is positioned to engage locking dog 47 between latch or ears 47L when tooth skip section 46 comes opposite the teeth of gear 45, as illustrated in FIGS. 4 and 4*a*, so that table 18 is not rotated by gear 45.

To assist the remeshing of the gear teeth at the point where trailing edge 46*b* of skip tooth section 46 comes into contact with gear 45, a bumper or kicker block 42B is secured below gear 42 (FIG. 5), positioned to contact a pin 45P secured to gear 45. The angular position of block 42B and pin 45P are such that their abuttment will initiate rotation of gear 45 as the first gear tooth at 46*b* comes into position opposite the teeth of gear 45.

When the trailing edge 46*b* of tooth skip section 46 is at the point where gears 42 and 45 come into meshing engagement, locking dog 47 is disengaged (i.e., lowered, in FIG. 6*a*) by the leading edge 49*a* of recess 49, so that the dog pivots to ride in recess 49, thereby freeing table 18 for rotation by the meshing of gear 45 with the toothed segment of gear 42. (For simplicity, the gear teeth are not shown in the plan views.) After table 18 has rotated three revolutions, the skip tooth section 46 is positioned as shown in FIGS. 4 and 5, and dog 47 is near the trailing edge 49*b* of recess 49. The the dog is then pivoted to its locked position between table latch members 47L as shown in FIG. 4*a*. The dog rides on the top surface of gear 38 (i.e., it is not in groove 49) and remains in this locked position until tooth skip section 46 again returns to the point for engagement of gears 42 and 45.

Referring to FIG. 8, there is diagrammatically illustrated the path of one complete preferred massage cycle as would be traced by a given point on massage element 23 when motion is delivered to support table 18 and to massage element 23 through their respective drive trains. From the arbitrary starting point illustrated by the position of selected point a' shown in FIG. 8, the point follows a first directional path of generally circular or loop configuration of one clockwise revolution about the axis A (shaft 24) of massage member 23, and then follows a second directional path of generally spiral configuration of three revolutions in the opposite direction, i.e., counterclockwise, about the axis B (shaft 19) of support table 18 before returning to the starting point at which another massage cycle is initiated. More particularly, the selected point makes one complete revolution of circular configuration b' about axis A, which is then followed in sequence in the opposite, or counterclockwise, direction about axis B, by a one-half circle at c', then one revolution of increasing spiral configuration d', then by one and one-half revolutions of decreasing spiral configuration e' and f', at which point the selected point is back at the starting point a' to begin a second cycle.

Gear 42 should be rotationally positioned with respect to boss 41 so that the edge 46*b* of tooth skip section 46 is just opposite gear 45, i.e., gear 42 is at the point of having just disengaged from gear 45, when table 18 and massage element 23 are in the respective positions shown in FIG. 4.

When electric motor 26 is activated by placing switch 28 in the "on" position, the motion of the drive shaft of motor 26 is delivered through the motor drive train comprising bevel gears 29–30, worm 32, and concentric gear 33-33', to massage element 23 and (when driven) to support table 18 by their drive trains comprising gears 38, 39-39' and 40, and gears 38, 42 and 45 respectively. Assuming the motor is energized with the gears in the assumed but arbitrary starting position shown in FIG. 4, massage element 23 will begin the clockwise revolution b' about axis A shown in FIG. 8, while support table 18 remains locked and stationary as skip tooth section 46 of gear 42 passes gear 45. During this period of the massage cycle, locking dog 47 is pivoted into latch 47L and effectively holds table 18 stationary. As circular revolution b' is completed and the selected point a' is back at its starting point, the skip tooth section 46 of gear 42 has rotated beyond gear 45 (FIG. 6), and locking dog 47 has retracted from latch 47L by falling into recess 49, as shown in FIG. 6*a*. Delivery of motion to both massage element 23 and support table 18 then starts, causing rotation of these means respectively in clockwise direction about axis A (shaft 24) and counterclockwise direction about axis B (shaft 19). By reason of this dual motion, the combined output motion has the form of a counterclockwide increasing, then decreasing spiral path, comprising path components c', d', e', and f' (FIG. 8). Upon return of selected point a' to the arbitrary starting point, skip tooth section 46 of gear 42 will again be at the point of having just disengaged from gear 45, locking dog 47 will be pivoted into its locked position in latch 47L, and massage element 23 will be in its original position with respect to support table 18. During the complete massage cycle, each of gears 38 and 42 will make one full revolution in effecting the five revolutions of the massage element.

In this path the circular movements b' and c', which are in opposite directions, are important to loosen dirt and oil on the skin; the outward spiral movement d' increases the area of cleansing and moves the removed material outwardly and away from the initially cleansed area. The decreasing spiral path e' and f' return the massage element to starting position. (In the foregoing description, it has been assumed for convenience that the device was started with the elements in the positions shown in FIG. 4. In practice, of course, the cycle can start with the gears and elements in any position.)

By way of illustration and not limitation, the dimensions of the path of massage tip motion may be as follows:

preferred spacing between the two massage tips 23—about ½"

preferred maximum diameter of spiral d'—about ½"

preferred diameter of circle b'—about ½"

The device can conveniently be used for skin buffing ("epidermabrasion") as by placing or mounting a cloth or loofa sponge over the rotating massage elements, so that the motion mildly "scrubs" the cloth against the skin. In like manner, other suitable coverings may be employed when soaps, creams, lotions, or the like are being applied to the face.

The massaging device of this invention is compact, lightweight, and designed for easy handling and transporting. In use, it provides a massaging movement that has been considered beneficial particularly in massaging the face, and in the application thereto of cleansers, soaps, creams, lotions and other cosmetic preparations. The massaging element shaped in the form of fingertips provides a gentle but firm touch to the skin not unlike that obtained when using the index and middle fingertips in facial massage. These fingertips of the massaging device may be of suitable plastic or rubbery material simulating the surface and firmness of the fingertips of the hand.

Although the preferred embodiment of the present invention has been illustrated and described in detail, it is to be understood that this invention is not limited thereto. Various changes can be made in the drive, the gearing, and the arrangement of parts, without departing from the scope and spirit of the invention as the same will now be understood by those skilled in the art.

What is claimed is:

1. A massage device comprising: a housing, an electric motor mounted by and within said housing; a massage element mounted for movement relative to said housing; and drive means connecting said motor to said massage element for generating a cyclical path of motion of said massage element comprising a circular motion followed by an increasing, then decreasing spiral path.

2. A device according to claim 1 wherein said drive means comprises two drive trains, one which drives the massage element continuously and which generates said circular motion, the other of which drives intermittently and which together with the first train generates said spiral path.

3. A massage device comprising: a housing, an electric motor mounted by and within said housing; a massage member mounted by said housing comprising a rotatable support table and a separately rotatable massage element mounted thereon; and drive means connecting said motor to said massage member for generating a circular motion followed by an increasing, then decreasing signal motion of said massage element, said drive means including two drive trains for imparting different motions to said support table and to said massage element.

4. A device according to claim 3 wherein one of said two drive trains rotates said table and wherein the other train rotates said massage element on said table as the table is being rotated.

5. A massage device comprising: a housing; an electric motor mounted within said housing; a massage member mounted in said housing comprising a rotatable support table and a separately rotatable massage element mounted thereon; and drive means connecting said motor to said massage member for imparting motion to said support table and massage element, said imparted motion causing a selected point on the massage element to move along a massage cycle comprising a first directional path of generally circular configuration, then a second path of generally spiral configuration in the opposite direction, said selected point being returned to said starting point to complete the cycle.

6. A device according to claim 5 in which said first directional path taken by said selected point comprises approximately one revolution about the axis of the massage element, and said second directional path taken by said selected point comprises approximately three revolutions about the axis of the support table.

7. A device according to claim 6 in which the three revolutions of the second directional path comprise in sequence approximately one and one-half revolutions of increasing spiral configuration, then approximately one and one-half revolutions of decreasing spiral configuration.

8. A device according to claim 5 in which the drive means drives the massage element about its axis while the support table remains stationary thereby creating said first directional path of generally circular configuration, and then drives the support table about its axis in the opposite direction while simultaneously continuing to drive the massage element, the dual opposite rotations creating the second directional path of generally spiral configuration.

9. A hand held massage device comprising: a housing; an electric motor mounted within said housing; a support table rotatably mounted on a support table shaft; a massage element mounted on said support table and rotatable with respect thereto on a massage element shaft extending through the support table and offset from said support table shaft; a first drive train connected to said motor; and two additional drive trains connected to said first drive train for separately driving said support table and massage element, the drive trains being geared so that said massage element is rotated through one revolution while the support table is stationary, and the massage element and support table thereafter being rotated simultaneously in opposite directions, whereby a selected point on the massage element will follow a first directional path of generally circular configuration, then a second directional path of generally spiral configuration.

10. A device according to claim 9 in which (a) the massage element drive train comprises a first gear connected to the motor drive train and rotatably mounted on a shaft, and a double gear mounted for rotation on the support table shaft, one gear of the double gear meshing with said first gear and the second gear of the double gear meshing with a gear mounted to rotate the massage element shaft; and (b) the support table drive train comprises a second gear mounted for rotation about an axis offset from that of said first gear and joined to the first gear to be simultaneously rotated therewith, and a gear mounted to the support table shaft for driving said shaft, the latter gear meshing with said second gear.

11. A device according to claim 10 in which said second gear is provided with a tooth skip section, said massage element being rotated by the massage element drive train while the skip tooth section disconnects the support table from the first drive train.

12. A device according to claim 11 in which the surface of the first gear is provided with a recess to receive a locking dog for locking said table during rotation through the tooth skip section of the second gear.

13. A device according to claim 9 in which the massage element is shaped similar to the fingertips of the index and middle fingers of the hand.

* * * * *